United States Patent [19]

Gilliland

[11] 3,974,471

[45] Aug. 10, 1976

[54] BRUSH CONTACT

[75] Inventor: Ralph Wilson Gilliland, Glenview, Ill.

[73] Assignee: Illinois Tool Works Inc., Chicago, Ill.

[22] Filed: July 30, 1975

[21] Appl. No.: 600,346

[52] U.S. Cl. ..... 338/202; 113/119; 338/171

[51] Int. Cl.[2] ..... H01C 1/12

[58] Field of Search ..... 338/171, 202, 118, 124, 338/123, 160, 167, 176; 29/630; 113/119; 200/252, 275

[56] References Cited

UNITED STATES PATENTS

| | | | |
|---|---|---|---|
| 2,248,675 | 7/1941 | Huppert | 113/119 X |
| 3,569,897 | 3/1971 | Laube et al. | 338/202 X |

*Primary Examiner*—C. L. Albritton

*Attorney, Agent, or Firm*—T. W. Buckman; R. W. Beart

[57] ABSTRACT

A wiper brush contact of miniature and microminiature size for use in potentiometers, variable resistors and the like, and including a plurality of densely arranged spring fingers projecting from a plate-like base portion in such angular offset relation to the plane of the base portion that the fingers are disposed in side-by-side closely spaced or even light contacting relationship but with the fingers being free to flex independently of one another to independently follow irregularities in cermet and metal film tracks of various types used in microminiature assemblies of the type contemplated; and with the base plate portion and spring contact fingers formed from a flat stamping with subsequent offsetting and orientation of the fingers relative to one another and to the base portion.

8 Claims, 9 Drawing Figures

Fig. 1
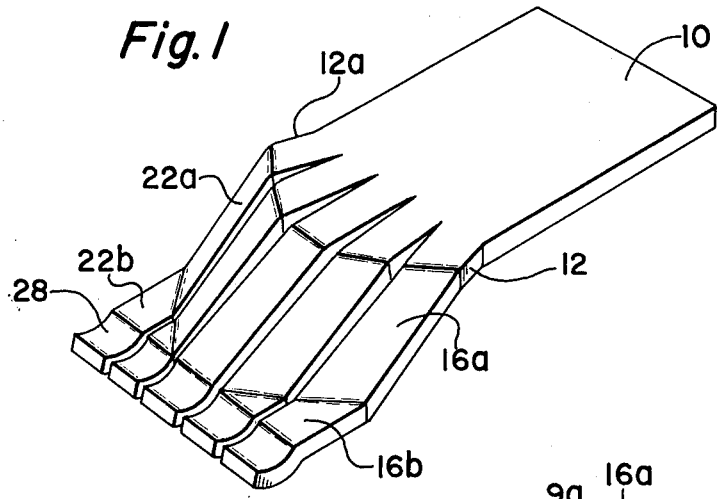
Fig. 2
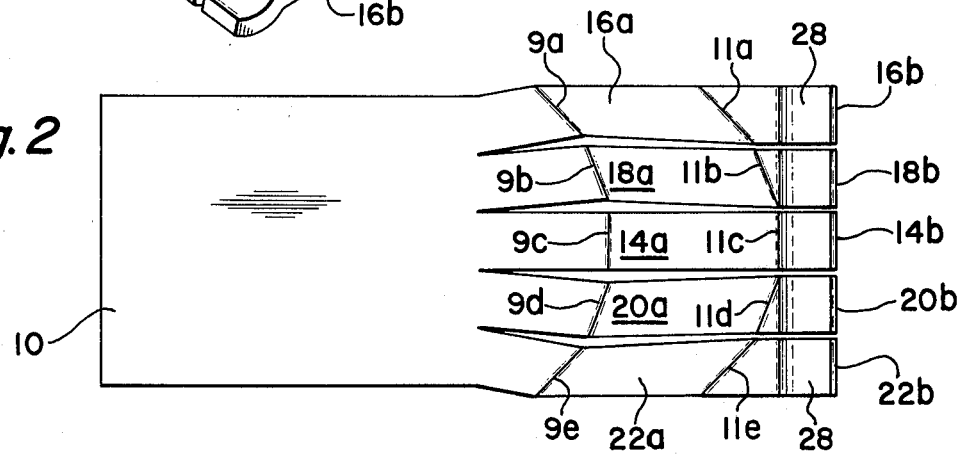
Fig. 3
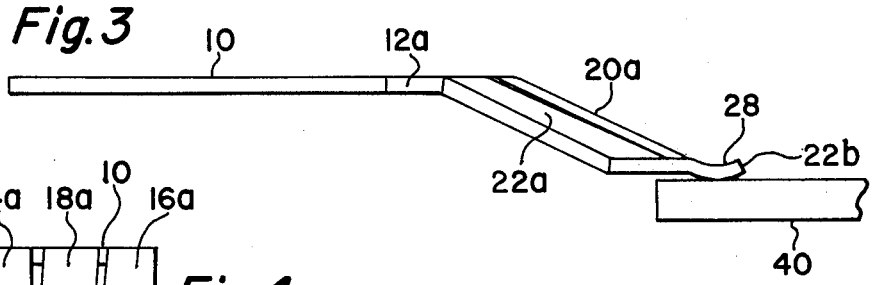
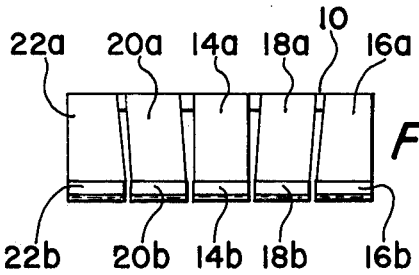
Fig. 4
Fig. 5
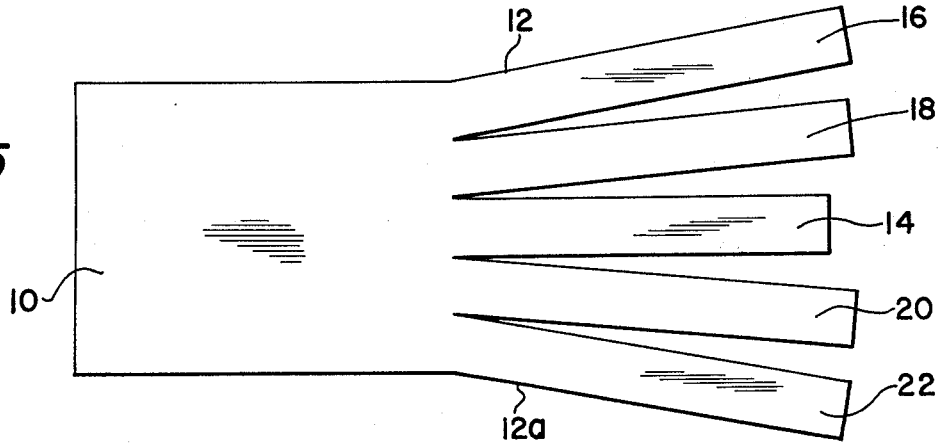

BRUSH CONTACT

BACKGROUND OF THE INVENTION

Resistive track elements used in microminiature potentiometers and variable resistors, such as flat elements of cermets or deposited metal film, as by sputtering and the like, usually present minute surface irregularities which are often of an abrasive character such as to not only impair the contact efficiency of a wiper brush but also result in excessive wear. With present day demands for reducing the size of such assemblies where the width of the resistive elements may be of the order of one-sixteenth inch and less, the cost of producing brush contacts for such assemblies has correspondingly increased. Efforts to reduce these costs have been made in the direction of multi-fingered microminiature brush contacts which may be used in straight line or rotary assemblies and which may be made from a number of suitable materials. In one form of multi-fingered contact, the fingers consist of a plurality of fine wires of heat treatable precious metal alloys and this requires costly assembly processes and apparatus. In other forms, the fingers are formed from a starting strip or blank leaving a finger supporting base portion. In the latter forms, the fingers have been formed by expensive die operations removing minute segments of material therebetween for independent flexing of the fingers but often leaving the fingers too delicate; or the fingers have been formed by a shearing operation on the strip often leaving the fingers incapable of independent flexing to properly follow the resistive track irregularities. In the latter form, the fingers have been mechanically spread apart to provide the required independent flexing therebetween.

SUMMARY OF THE INVENTION

According to the present invention, the multi-fingered wiper brush contact is made from strip material with the fingers projecting from root connections with the base and bent adjacent the root connections along transverse angular lines aggregating an arc to locate the contacting tip portions of the fingers in closely spaced orientation and offset from the plane of the base. The tip portions may be further bent along similarly oriented lines to generally parallel the base in offset relationship and present lower surface portions normally curved for contact with a conductive or resistive track in the environmental assembly.

An object of the invention is to provide a one-piece stamped multi-fingered brush contact with free independent flexing of each individual finger in wiping over any irregularities in the track so as to reduce frictional wear and assure proper mutual contact thereacross.

Another object of the invention is to provide lines of bending for the individual fingers such that they are oriented along the lines of bending during manufacture from an original blank position to closely spaced positions permitting individual independent flexing.

A further object of the invention is to dispose the contacting finger tip portions in offset relationship to the base by inclined strut portions between the base and the tip portions.

The above and other objects of the invention will in part be obvious and will be hereinafter more fully pointed out in the detail description of the accompanying drawings in which, FIG. 1 is a perspective view of the multi-fingered brush contact;

FIG. 2 is a top plan view of FIG. 1;

FIG. 3 is a side elevation of FIG. 2 showing a track with which the fingers contact in an assembly;

FIG. 4 is a front end view of FIG. 1;

FIG. 5 is a plan view of a blank from which the contact of FIG. 1 is formed;

Figure 6:
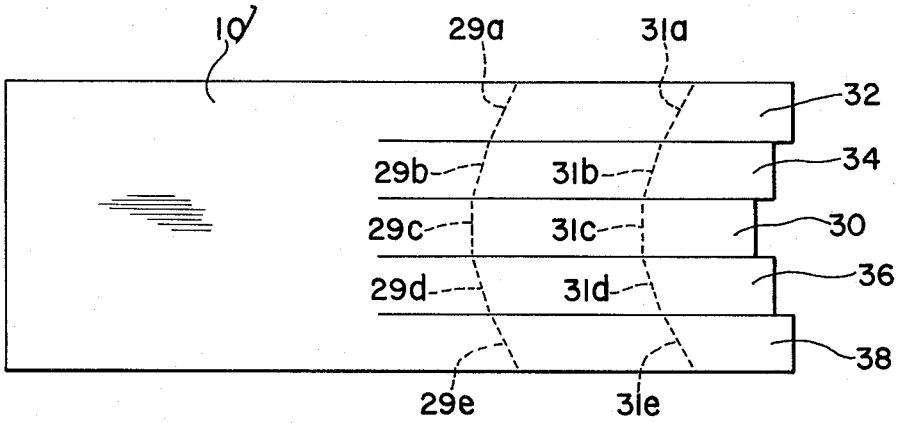
FIG. 6 is a plan view of another form of blank with location of bend lines shown in dotted lines.

With reference to the accompanying drawing, and particularly FIG. 5, there is shown one form of flat strip blank as a stamping from which a multi-fingered wiper or brush contact is formed. This blank includes an end portion or base 10 which may be configured for attachment to a lead screw or rotary type potentiometer assembly, and an opposite fingered portion with opposite edges 12, 12*a* slightly inclined outwardly from the adjacent edges of the base portion 10. Within the edges 12, 12*a*, elongate generally triangular portions of material have been removed to provide a central finger 14 and outwardly disposed pairs of fingers 16, 18 and 20, 22 each inclined outwardly from the central finger 14 in fan-like array. As illustrated, the finger 14 is of a predetermined length with the fingers 18, 20 and 16, 22 of progressively slightly greater length from the root connections with the base portion 10, that is, along the apices of the triangular spaces between the fingers. This forming arrangement of the fingers in the blank may also be accomplished by shearing a rectangular blank to form the finger portions and then slightly separating or forming the fingers to provide the triangular spaces therebetween.

The blank of FIG. 5 is subjected to a compound bending operation or plural bending operations, as die forming and shaping, to bend the fingers 16, 18, 14, 20, 22 out of the plane of the base portion along transverse angular lines 9*a*, 9*b*, 9*c*, 9*d*, 9*e*, adjacent the root connections of the fingers with the base portion as in FIG. 2. The center line 9*c* is angularly transverse to the longitudinal axis of the center finger 14; the lines 9*b*, 9*d* being slightly angled away from the line 9*c* toward the base, and the lines 9*a*, 9*e* being further angled in this direction, so that these lines in the aggregate provide an arcuate shape convex toward the free ends of the fingers and concave toward the base. This bending of the fingers will provide finger strut portions 16*a*, 18*a*, 14*a*, 20*a*, 22*a* inclined downwardly and forwardly from the base 10 and will bring the lower edges of the strut portions inwardly closer together along with the tip portions 16*b*, 18*b*, 14*b*, 20*b*, 22*b* thereof, thus at least partially closing the original triangular gaps between the fingers in the blank of FIG. 5. In the same bending operation, or as a separate operation, the tip portions 16*b*, 18*b*, 14*b*, 20*b*, 22*b* are bent forwardly and upwardly relative to the strut portions along lines 11*a*, 11*b*, 11*c*, 11*d*, 11*e*, respectively, which aggregate an arcuate shape similar to that of the lines 9*a*, *b*, *c*, *d*, *e* to further close the gaps between the edges thereof and present the tip portions in downwardly and forwardly offset and approximately parallel relationship to the plane of the base portion with the original staggered positions of the ends of the fingers (FIG. 5) now in transverse alignment.

The formed multi-finger brush is shown in FIG. 1 through 4 with the tip portions 16*b*, 18*b*, 14*b*, 22*b*, providing the contact surfaces for engagement with a suitable track 30, as shown in FIG. 3, which may be typically employed in a potentiometer or variable resistor assembly. After the described bending of the fingers, the spacing therebetween is greater in the region of the lines 9*a*, *b*, *c*, *d*, *e* from which the spacing is reduced toward the lines 11*a*, *b*, *c*, *d*, *e* and between the edges of the tip portions. Thus, and even with light contact between the edges of the tip portions, each finger is free to independently flex and be displaced independently of adjacent fingers in accordance with irregularities encountered in the track 30. The under surfaces of the finger tip portions contact the track and these tip portions may be variously shaped in providing the contacting surfaces, as by being curved or dimpled slightly to present rounded or radiused contacting surfaces 28. It should be noted that as the fingers are deflected upwardly due to irregularities on the track, they will also deflect transversely away from the adjacent finger due to the curvature of the bend line, thus insuring independent flexing.

Figure 7:
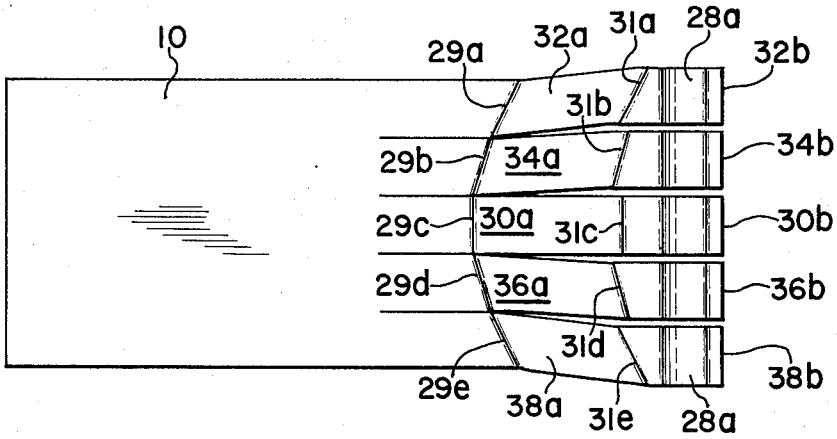
FIG. 7 is a top plan view of the multi-fingered brush contact.
Figure 8:
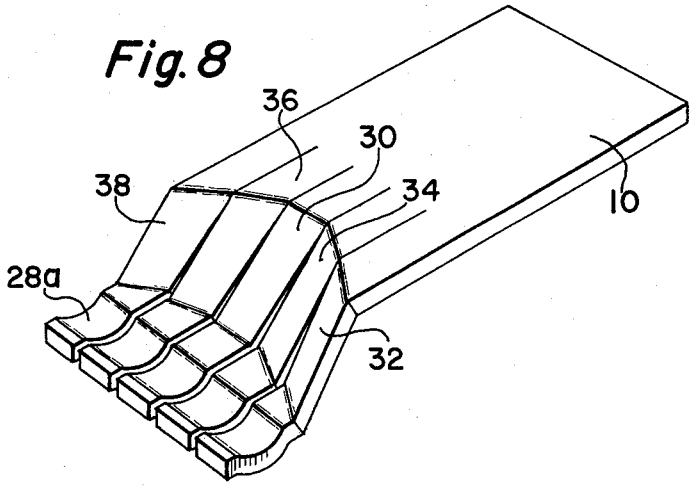
FIG. 8 is a perspective view of the contact, made from the blank of FIG. 6.
Figure 9:
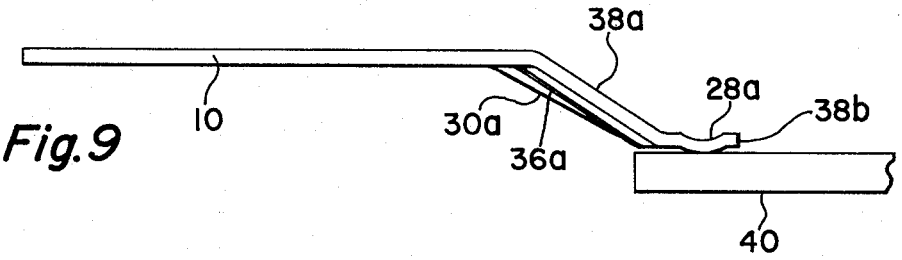
FIG. 9 is a side elevation of the brush contact showing a track with which the fingers contact in an assembly.

Another blank formation is shown in FIG. 6 with the fingers formed by shearing the blank leaving the pairs of fingers 32, 34 and 36, 38 to opposite sides of a central finger 30 which is of predetermined length and the other fingers may be of slightly greater length from the root connections with the blank but this is not essential as long as sufficient lengths remain for the contact surfaces. Bend lines 29*a*, 29*b*, 29*c*, 29*d*, 29*e* are illustrated in dotted line location adjacent but spaced from the root connections of the fingers with the base portion 10. The center line 29*c* is transverse to the longitudinal axis of the center finger 30; the lines 29*b*, 29*d* being slightly angled away from the line 29*c* and also away from the line 29*c* and also away from the base and toward the tip portions 34*b*, 36*b* of the respective fingers, and the lines 29*a*, 29*e* are further angled in this same direction so that these lines in the aggregate provide an arcuate shape concave toward the free ends of the fingers and convex toward the base. The blank is subjected to suitable bending for shifting the fingers along the bend lines out of the plane of the base 10 and inclined downwardly therefrom to provide inclined finger strut portions 32*a*, 34*a*, 30*a*, 36*a*, 38*a* and will shift the outer pairs of strut portions, along with the tip portions, slightly away from the center finger and from each other to provide clearance along the adjacent sheared edges as shown in FIG. 7. Thus, this orientation is to separate the fingers from the original sheared blank portions thereof, and insure independent flexing of the finger. To bring adjacent edges of the tip portions 32*b*, 34*b*, 30*b*, 36*b*, 38*b* closer together after this separation of the edges of the strut portions, bending may be accomplished along lines 31*a*, 31*c*, 31*b*, 31*d*, 31*e* which are oriented similar to lines 29*a*, *b*, *c*, *d*, *e*, that is, concave toward the free ends of the fingers and convex toward the base 10. FIG. 8 shows the wiper contact as thus completed and in FIG. 9 the completed wiper brush is also shown with the tip portions including radiused contact surfaces 28*a* wiping over the track 30.

Thus it is apparent that the invention provides a one piece brush contact with independently flexing, yet densely arranged fingers.

I claim:

1. A miniature multifingered wiper brush contact for use with a potentiometer, variable resistor or like assembly and comprising a body portion for attachment to an operator in the assembly, and multiple fingers projecting from root connections with the body portion and each finger extending downwardly from a transverse bend line thereacross adjacent a corresponding root connection to provide a strut portion terminating in a contact tip portion, the aggregation of the individual bend lines substantially defining an arc concave toward the body portion, the opposing side edges of adjacent fingers being laterally spaced in the vicinity of the bend lines, the bend lines reorienting the strut portions so that the opposing side edges of adjacent fingers in the vicinity of the tip portions are more closely spaced than at the bend lines, the fingers thereby being adapted to flex independently while providing a maximum density of contact tip portions along a given line of contact.

2. A wiper brush contact as in claim 1, wherein the tip portions join the adjacent ends of strut portions along secondary bend lines further orienting the tip portions relative to one another and relatively toward the projected plane of the base portion.

3. A wiper brush contact as in claim 1, wherein the aggregation of the individual secondary bend lines substantially define an arc convex to the tip portions.

4. A wiper brush contact as in claim 1, wherein the bottom edges of the tip portions present curved contact surfaces.

5. A miniature, multifinger wiper brush contact for use in contacting a resistance surface as in a potentiometer, variable resistor or the like; and comprising a body portion for attachment to an operator in the assembly and multiple fingers projecting from root connections at one end of the body portion, each finger extending outwardly and downwardly from a first transverse bend line thereacross adjacent a corresponding root connection to provide a strut portion terminating in a contact tip portion spaced outwardly and downwardly from said first bend line, the aggregation of the individual first transverse bend lines defining an arc, convex in a given direction relative to the body portion, the first bend line thereby reorienting the strut portions relative to the root connections so that the spacing between the opposing side edges of the strut portions is changed from the spacing between the fingers at the first bend line, the contact tip portions being deformed in a direction away from the plane of the body portion along a line perpendicular to the longitudinal axis of the wiper brush which defines the path of relative movement between said wiper brush and an associated resistance surface to provide aligned, curved contact surfaces in a plane generally parallel to the plane of the body portion.

6. The wiper brush contact in accordance with claim 5, including a second transverse bend line across the fingers adjacent the contact tip portions positioned intermediate the curved contact surfaces and said first transverse bend line, the aggregation of the individual second transverse bend lines defining an arc convex in the same direction relative to the body portion as the first transverse bend lines.

7. The wiper brush contact in accordance with claim 5, wherein the first bend lines are convex toward the body portion.

8. The wiper brush contact in accordance with claim 5, wherein the first bend lines are convex away from the body portion.

* * * * *